United States Patent [19]

Caudill et al.

[11] 4,357,093

[45] Nov. 2, 1982

[54] PHOTOCONDUCTOR TENSIONING DEVICE

[75] Inventors: Allison H. Caudill, Lafayette, Colo.; William H. Bruce, Jr., Walworth, N.Y.

[73] Assignee: International Business Machines Corporation, Armonk, N.Y.

[21] Appl. No.: 217,965

[22] Filed: Dec. 18, 1980

[51] Int. Cl.[3] ..... G03G 15/00

[52] U.S. Cl. ..... 355/3 R; 101/415.1; 355/3 DR; 355/16

[58] Field of Search ..... 355/3 R, 3 DR, 16; 101/415.1, 378

[56] References Cited

U.S. PATENT DOCUMENTS

| | | | |
|---|---|---|---|
| 2,085,093 | 6/1937 | Gauthier | 178/5 |
| 3,408,933 | 11/1968 | Hermach et al. | 101/415.1 |
| 3,438,324 | 4/1969 | Meade et al. | 101/378 |
| 3,646,886 | 3/1972 | Benda et al. | 101/378 |
| 3,834,808 | 9/1974 | Takahashi | 355/3 R |
| 4,111,119 | 9/1978 | Takizawa et al. | 101/415.1 |
| 4,183,652 | 1/1980 | Yanagawa | 355/3 DR |
| 4,277,164 | 7/1981 | Fortmann | 101/415.1 |

OTHER PUBLICATIONS

IBM TDB to L. C. Brown et al., "Drum Seal Interlock", vol. 20, No. 10, Mar. 1978, pp. 3837-3838.

IBM TDB to P. S. Bolan et al., "Drum Gap Seal", vol. 18, No. 8, Jan. 1976, p. 2464.

IBM TDB to C. Sutton, "Photoconductor Drum Seal", vol. 18, No. 6, Nov. 1975, p. 1713.

IBM TDB to P. S. Bolan et al., "Lock Mechanism for Printer Drum Gap Seal", vol. 18, No. 7, Dec. 1975, pp. 2163-2164.

*Primary Examiner*—R. L. Moses

*Attorney, Agent, or Firm*—J. Jancin, Jr.; Earl C. Hancock; Yen S. Yee

[57] ABSTRACT

A clamping device for securing a photoconductor in the form of a closed loop, flexible sleeve on a drum having a channel on the drum periphery, and with the channel running substantially parallel to the drum central axis, along the length of the drum, is disclosed. The clamping device comprises an elongated bar having a cross-sectional configuration for fitting within the channel, means for latching the bar to the drum when the bar is in position within the channel, and an electrically conducting spring positioned relative to the bar and the sleeve for making an electrical connection between the photoconductor sleeve and the drum, and for applying variable tension to the sleeve in response to forcing of the sleeve partially into the channel by the bar.

24 Claims, 8 Drawing Figures

PHOTOCONDUCTOR TENSIONING DEVICE

DESCRIPTION

1. Technical Field

This invention relates generally to a sheet clamping device, and more particularly to a clamping device for securing a flexible photoconductor of the type having a form of a closed loop sleeve on a drum for use in a copier or printer.

2. Background Art

In a low cost, state of the art copier or printer machine, a sheet of photoconductor is wound around an electrophotographic drum. Often, the sheet is wrapped around the drum using a clamping device, also known as a tensioning device. Such photoconductor sheets can be used and reused in an electrophotographic machine many times to make prints or copies.

For low cost copier applications, this type of photoconductor offers advantages of both lower initial machine cost and lower subsequent photoconductor replacement cost, and is therefore preferred over prior art arrangements such as increment moveable photoconductor rolls or coating-on-drum type design having an aluminum drum and on which a photosensitive coating is directly applied. However, the low cost photoconductor sheet generally requires replacement more often as compared to some prior art designs because of the shorter life span of a photosensitive composition used in such low cost photoconductor sheets.

Photoconductor sheets incorporated in modern low cost copiers or printers therefore do not remain in service indefinitely, instead, they must be replaced periodically. Typically, such a photoconductor sheet is replaced at the usage rate of about every 10,000 or more copies. Moreover, the useful life of a photoconductor may be cut short substantially because of physical damage to the photoconductor sheet due to foreign objects, and mishandling during the clearance of a paper jam performed either by an operator or a service person.

In prior copier machines, the replacement of a used or damaged photoconductor typically involves an unfastening and removal of the used or damaged photoconductor from the electrophotographic drum, and a disconnection of any associated wiring or electrical contact to the photoconductor itself. A new photoconductor is then removed from its protective jacket, and properly fastened onto the electrophotographic drum. As is typically the case, the required associated wiring or electrical contact to the photoconductor must also be restored.

The above-described photoconductor replacement procedure typically involves, in addition, an alignment of the photoconductor to the electrophotographic drum as well as handling of loose machine parts which could be inadvertently misplaced. Such replacement task may appear to be or is actually too complex to an untrained operator. Furthermore, once the new photoconductor is removed from its protective jacket, some such photoconductors can not be exposed to an average lighted room for more than 5 to 10 minutes without suffering partial or permanent damage. Hence, there is an additional requirement that the photoconductor replacement be completed quickly to avoid any potential damage to the new photoconductor itself. The latter requirement tends to add pressure and further complicates the replacement procedure. For these reasons, most photoconductor replacements, heretofore, are performed by trained service person.

Some prior sheet holding means include an arrangement for mounting sheet material on a cylinder surface. As an example, U.S. Pat. No. 2,085,093 to Gauthier, discloses a sheet holding means for a picture transmission system. According to one embodiment of the Gauthier patent, a cylinder is provided with a groove into which projects a series of pins adapted to engage a series of apertures in one end of a sheet. A bar is provided on one face with a series of pins which engages apertures in the other end of the sheet. After the pins of the bar engage the apertures, the bar is forced into the groove and locked in place to apply an even tension to the sheet and holds it in contact with the surface of the cylinder.

According to another embodiment of the Gauthier patent, the bar may be pivoted at one end and latched at the other so as to hold the bar in the groove of the cylinder.

Still according to another embodiment of the Gauthier patent, the bar is coated with rubber or other frictional material, and is provided along its low edge with notches to accommodate the pins carried by the cylinder. In this embodiment, only one end of the sheet is provided with apertures to engage the pins of the cylinder. The sheet is forced into good contact with the surface of the cylinder by the frictional engagement of the rubber coating with the other end of the sheet.

A prior photoconductor drum seal for a copier is disclosed by L. C. Brown, et al, entitled "Drum Seal Interlock", pages 3837–38, Vol. 20, No. 7, March 1978, IBM Technical Disclosure Bulletin. According to this disclosure, a drum having a groove is configured to receive a wrap-around photoconductor sheet. The ends of the photoconductor sheets are retained internally to the drum by a sealed bar. An interlock switch is provided to ensure proper placement of the sealed bar in the groove of the drum so as to avoid machine damage.

A prior photoconductor clamping device or tensioning device for a copier is disclosed in U.S. Pat. No. 3,834,808 to Takahashi et al. According to this patent, the disclosed apparatus comprises a cylindrical drum having a portion of its surface cut away to provide an axially extending notched portion in the surface of the drum, and clamping means provided in the notched portion. The clamping means includes a first holding means for holding one end of a photosensitive sheet, and a second holding means having an elastic member connected between the drum and the other end of the photosensitive sheet for resiliently holding the photosensitive sheet on the drum.

Another prior photoconductor sheet clamping device is described in U.S. Pat. No. 4,183,652 to Yanagawa. The disclosed device includes a drum having a recess, a front end clamp member in the recess for clamping the leading end portion of a photoconductor sheet and a back end clamp member for clamping the trailing end portion of the photoconductor sheet.

DISCLOSURE OF INVENTION

It is a principal object of the present invention to provide an improved clamping device for securing a flexible photoconductor sleeve on a copier/printer drum.

It is another principal object of the present invention to provide a clamping device for securing a flexible photoconductor of the type having the form of a closed loop sleeve on a drum.

It is yet another principal object of this invention to provide a clamping device which can be operated simply, easily and quickly to replace a photoconductor sleeve by an untrained operator.

It is also an object of this invention to provide a clamping device wherein proper tension on the photoconductor sleeve around the drum is achieved automatically in the photoconductor sleeve replacement procedure.

It is another object of the present invention to reduce tight tolerances on the manufacture of the photoconductor sleeve, and at the same time ensuring proper tension of the photoconductor sleeve around the drum.

It is also another object of this invention to provide a clamping device wherein an electrical contact to the photoconductor sleeve is made automatically in an integral step of the photoconductor sleeve replacement procedure.

It is generally an object of this invention to provide an improved, low cost copier or printer.

These and other objects of the present invention can be achieved by way of a clamping device for securing a photoconductor in the form of a closed loop, flexible sleeve on a drum having a channel on the drum periphery, and with the channel running substantially parallel to the drum central axis, along the length of the drum. The clamping device comprises an elongated bar having a cross-sectional configuration for fitting within the channel, means for latching the bar to the drum when the bar is in position within the channel, and an electrically conducting spring positioned relative to the bar and the sleeve for making an electrical connection between the photoconductor sleeve and the drum, and for applying variable tension to the sleeve in response to forcing of the sleeve partially into the channel by the bar.

The nature, principle and utility of the present invention will be better understood from the hereinafter detailed description of the invention when read in conjunction with the accompanying drawings.

BRIEF DESCRIPTION OF DRAWINGS

Details of the invention will be described in connection with the accompanying drawings, in which.

BEST MODE FOR CARRYING OUT THE INVENTION

Figure 1:
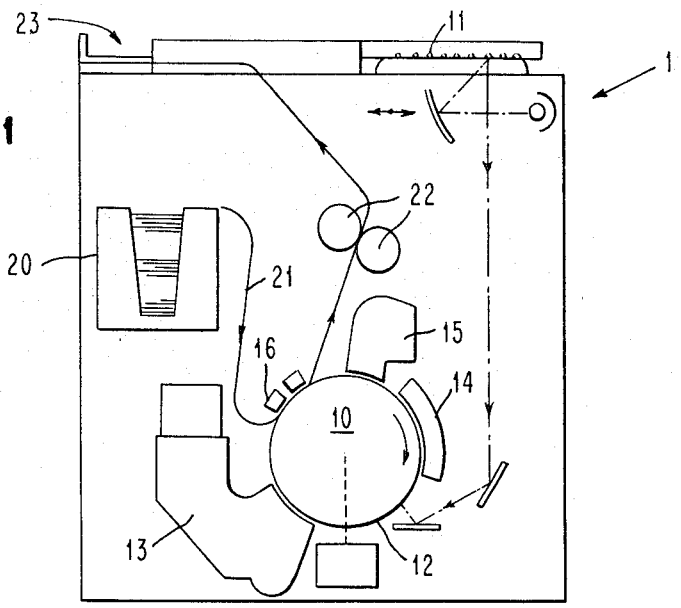
FIG. 1 is a sectional illustration of an electrophotographic copier employing an embodiment of the present invention.

Referring to FIG. 1, electrophotographic copier 1 employs an embodiment of the present invention. Copier 1 includes a photoconductor 12 carried by an electrophotographic drum 10. To make a copy of an original document 11, an electrostatic latent image of the page must be produced. This is accomplished by having an image area of photoconductor 12 first subjected to uniform electrostatic charge at corona station 14. The image area on photoconductor 12 is then selectively imaged by light reflected from the original document 11. The resulting electrostatic latent image on photoconductor 12 is then toned by a developer 13 by applying a toner to the electrostatic image. The developed image is then removed from the photoconductor image area to a copy sheet at transfer station 16 for subsequent fixing. In addition, the image area may be subjected to cleaning at station 15, as the drum 10 rotates in the clockwise direction at a constant speed. Sheets of paper are supplied, one sheet at a time, from bin 20. These sheets of paper follow path 21, including passing through hot fusing rolls 22, to reach exit pocket 23.

Details of an electrophotographic copier are well known to those skilled in the art and form no part of this invention. It is to be understood that a variety of techniques exists for performing the various individual functions of the electrophotographic process identified.

Copier 1 employs a flexible photoconductor 12 of the type having a form of a closed loop sleeve. As will be described hereinafter, this type of photoconductor is inherently simpler and less expensive to manufacture than prior coating-on-drum type photoconductor design having an aluminum drum and on which a photosensitive coating is directly applied. Similarly, this flexible photoconductor sleeve design also has a cost advantage over increment moveable photoconductor rolls. More specifically, the cost of an automatically incremented photoconductor roll system may well approximate the manufacturing cost of an entire low-cost copier. For these reasons, this type of photoconductor offers advantages of both lower initial machine cost and lower subsequent photoconductor replacement cost to a customer.

Figure 6:
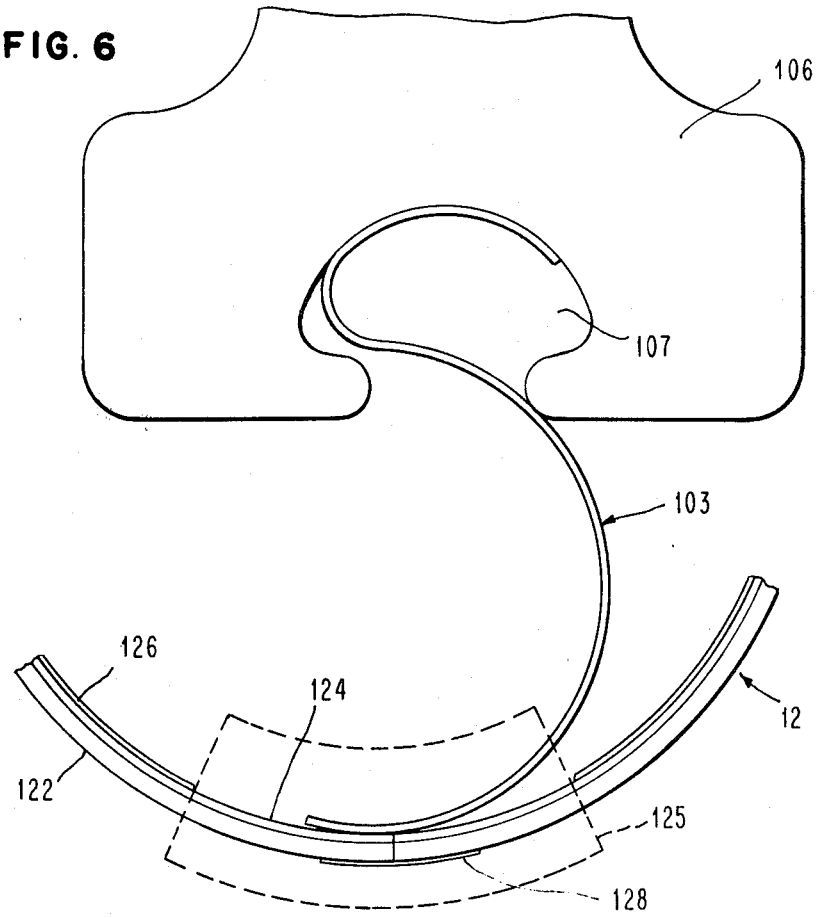
FIG. 6 is an expanded sectional illustration of FIG. 4 showing in detail the S-shaped spring making electrical contact with the elongated bar and the photoconductor sleeve aluminum ground plane area.
Figure 2:
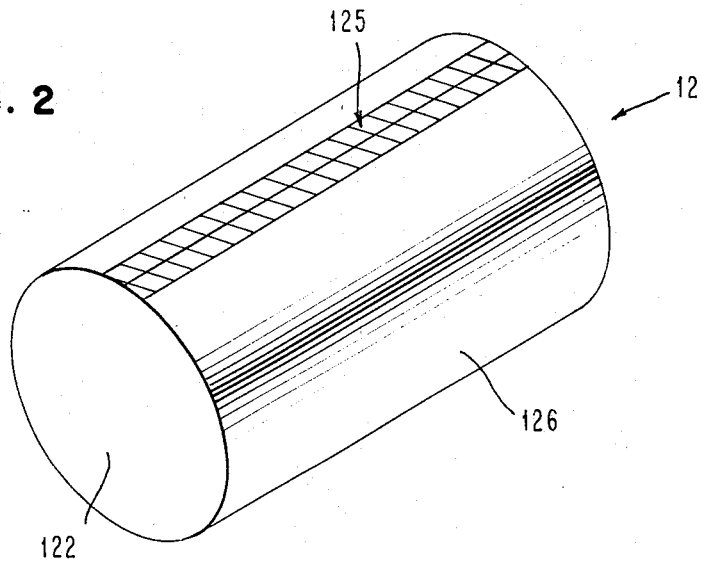
FIG. 2 is a perspective illustration of the photoconductor sleeve for use with the tensioning device in FIG. 3.

Referring to FIGS. 2 and 6, photoconductor sleeve 12 has a plastic film backing 122, which is sold commonly under the trademark Mylar, and is formed from a photoconductor sheet by bonding its two ends using adhesive tape 128. A layer of aluminum 124 is deposited on the Mylar backing 122 to form a ground plane. A photosensitive layer 126, such as zinc oxide, is then deposited on top of aluminum layer 124 on the outside surface of photoconductor sleeve 12. To facilitate electrical connection to aluminum ground plane 124, a strip of photoconductor on area 125 along the length of photoconductor sleeve 12 is removed exposing the aluminum ground plane 124.

Figure 3:
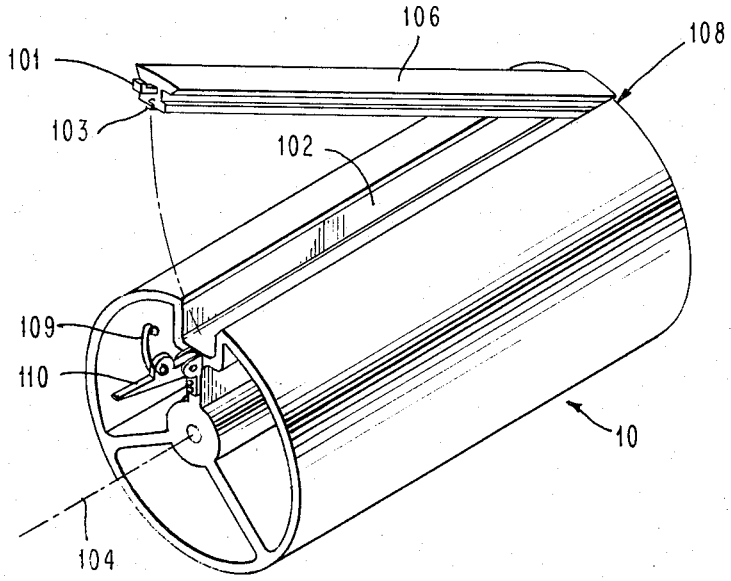
FIG. 3 is a perspective illustration of the electrophotographic drum tensioning device for securing the photoconductor sleeve in FIG. 2.
Figure 7:
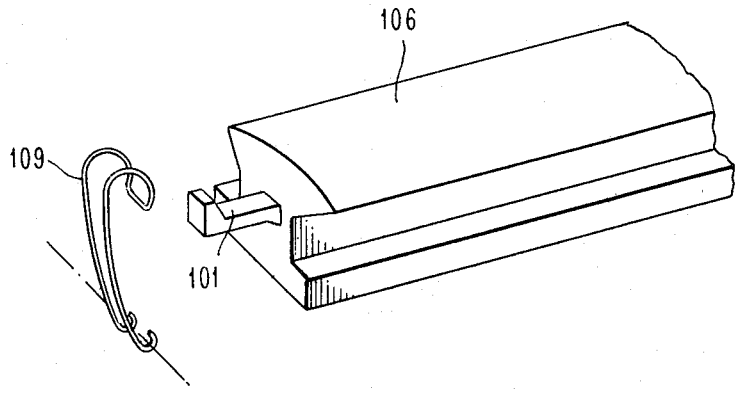
FIG. 7 is a detailed perspective view of the latching mechanism showing the latching hook disengaged from the latching loop.
Figure 8:
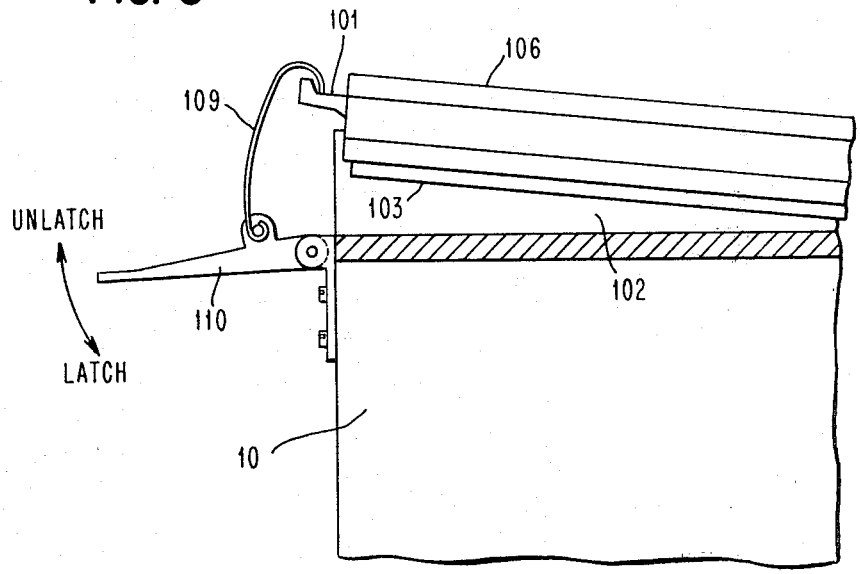
FIG. 8 is a detailed side view of the latching mechanism showing the latching hook in relation to the latching loop.

Referring to FIG. 3, drum 10 is a specially designed device having thereon a unique photoconductor sleeve tensioning feature. The drum 10 has a channel 102 on the cylindrical drum periphery thereof, running substantially parallel to the drum central axis 104, along the length of the drum 10. An elongated bar 106 having a cross sectional configuration for fitting within the channel 102, may be pivotally mounted at one of its ends at an internal point 108 on drum 10. Referring to FIGS. 7 and 8, a latching hook 101 may also be provided at the other end of bar 106. Latching loop 109 pivotally mounted at a point on lever 110, which in turn is mounted on drum 10, is placed over hook 101 of bar 106 for securing it to drum 10 when bar 106 is in position within channel 102. Latching is accomplished by moving lever 110 from an unlatched position to a latched position. Further, elongated bar 106 is designed to fit tightly within channel 102 so as to prevent toner particles or carrier beads, which are used in developer station 13 (FIG. 1), from entering the channel 102. A slot 107 (FIG. 6) along the underside of elongated bar may be also provided to engage one of two transverse ends of S-shaped spring 103 which is to be described immediately below.

Figure 4:
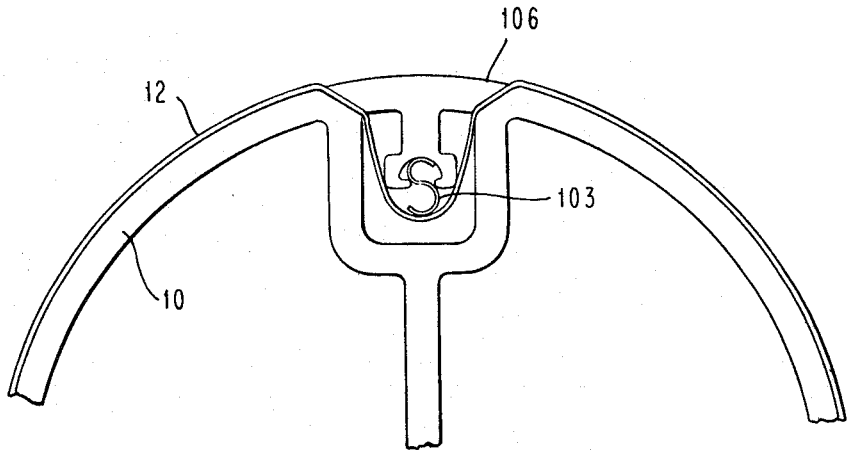
FIG. 4 is a sectional illustration of the electrophotographic drum tensioning device of FIG. 3 showing the photoconductor sleeve on the drum, the elongated bar and the S-shaped spring.
Figure 5:
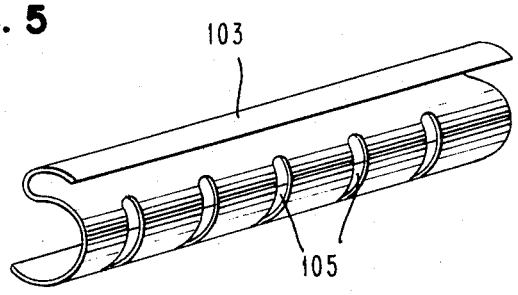
FIG. 5 is a perspective illustration of the S-shaped spring used in FIG. 4.

Referring also to FIG. 4, spring 103 positioned relative to the bar 106 and the sleeve 12 is provided for applying variable tension to photoconductor sleeve 12 in response to forcing the sleeve 12 partially into the channel 102 by the bar 106. As shown in FIG. 5, the spring 103 is an elongated structure having a substantially S-shaped cross section along the channel 102. Elongated spring 103 may also contain slots 105 along its length so as to provide greater flexibility of spring 103, thereby accommodating wider tolerances in the diameter of sleeve 12 while maintaining proper even tension on sleeve 12 around the periphery of drum 10. Such spring 103 may be made of electrically conductive material, i.e., metal, and is attached also for establishing an electrical connection between the aluminum layer 124 of the sleeve 12 and the drum 10 by way of bar 106 when the sleeve 12 is forced partially into the channel 102 by the bar 106.

Referring to FIG. 6, elongated spring 103 has one of its two transverse ends fitted into slot 107 of bar 106, and the other in contact with exposed aluminum area 125 of aluminum ground plane 124. The variable tensioning action of elongated spring 103 establishes a good electrical connection for proper grounding of aluminum layer 124 of photoconductor sleeve 12. The same action also evenly holds flexible photoconductor sleeve 12 radially inward on the periphery of drum 10 for use in copier 1.

As referred to above, because of the variable tension provided by spring 103, proper electrical contact and tension on the photoconductor sleeve 12 can also be maintained for sleeves 12 having slightly different diameters. This advantage translates into a reduction in the tolerances on the manufacture of the photoconductor sleeve 12 and thus further reducing its cost substantially relative to prior photoconductors.

This type of low cost photoconductor sleeve 12, however, must be replaced periodically. Typically, such photoconductor sleeve 12 is replaced at the usage rate of about every 10,000 or more copies. Moreover, the useful life of a photoconductor sleeve 12 may be cut short substantially because of physical damages to the photoconductor sleeve 12 due to foreign objects, such as paper clips, pens, etc. which fall inadvertently into copier 1. In addition, photoconductor replacement may also be necessitated by damages to the photoconductor sleeve 12 caused during the clearance of a paper jam performed by an operator. Most photoconductor replacements heretofore are performed by trained service persons. The photoconductor tensioning device according to the present invention can be operated simply, easily and quickly to replace a photoconductor sleeve 12 by an untrained operator. Replacement of such sleeve 12 will be described next.

To replace photoconductor sleeve 12, the electrophotographic drum 10 is either removed entirely from copier 1 or otherwise rendered accessible in cantilever fashion within copier 1. Elongated bar 106 is released and moved pivotally from its latched position to an open position. The used photoconductor sleeve 12 is removed by sliding it out from the upper end of drum 10. A new photoconductor sleeve 12 is removed from its protective shipping jacket, and is then slid over drum 10 with bar 106 still open. Area 125, which exposes the aluminum ground plane 124 along the length of photoconductor 12, is pressed into channel 102. Pivoting at point 108, bar 106 is lifted and closed. The "scissoring" action of bar 102 as it is being forced into channel 102, brings the tensioning spring 103 into intimate contact with area 125 of aluminum ground plane 124. This electrical contact on area 125 made by spring 103 grounds the aluminum layer 124 of sleeve 12 by way of bar 106, drum 10, and the drum bearings (not shown) to the main frame (not shown) of copier 1. This action also automatically draws the sleeve 12 tightly around the cylindrical surface of drum 10. Latching loop 109 is then placed over hook 101 of bar 106 to secure the bar 106 to drum 10 using lever 110 (FIG. 8). Drum 10 with new photoconductor sleeve 12 is then returned to its operating position in copier 1.

The above described photoconductor tensioning device makes possible this easy to follow photoconductor sleeve 12 replacement procedure. Replacement of photoconductor sleeve 12 using this procedure allows the operator both hands free to install the new photoconductor sleeve 12. The drum 10 and bar 106 remain one integral unit during replacement. In addition, electrical disconnection and reconnection to the photoconductor sleeve 12 is accomplished automatically and without loose parts to be misplaced or lost. In short, the photoconductor tensioning device according to the present invention allows an untrained operator to replace a photoconductor sleeve 12 easily and quickly in a simple to follow replacement procedure.

Although the photoconductor clamping device, also known as tensioning device in FIG. 3 is shown and described in connection for use in a copier, it is clear that the device is equally applicable in electrophotographic printer applications.

From the preceding detailed description of Applicants' invention, it will be seen that electrophotographic copiers or printer machines incorporating such a photoconductor tensioning device have advantages heretofore not possible to achieve. In addition to the variation and modification of Applicants' disclosed apparatus, which have been suggested, many variations and modifications will be apparent to those skilled in the art, and accordingly, the scope of Applicants' invention is not to be construed to be limited to the particular embodiment shown or suggested.

We claim:

1. An electrophotographic copier having a drum comprising:

a photoconductor having a form of a closed loop sleeve for mounting on said drum;

a channel on the drum periphery, running substantially parallel to the drum central axis, along the length of said drum;

an elongated bar having a cross sectional configuration for fitting in said channel;

means for latching said bar to said drum when said bar is in position within said channel; and a spring positioned relative to said bar and said sleeve for applying tension to said sleeve in response to forcing of said sleeve partially into said channel by said bar;

whereby said closed loop sleeve is held radially inwardly on the periphery on said drum by the tensioning action of said spring.

2. An electrophotographic copier as set forth in claim 1 wherein said spring is of electrically conductive material and is attached for establishing an electrical connection between an area of said sleeve and said drum by way of said bar and said latching means when said sleeve is forced partially into said channel by said bar.

3. An electrophotographic copier as set forth in claim 1 wherein said spring is an elongated structure having a substantially S-shaped cross section.

4. An electrophotographic copier as set forth in claim 3 wherein said elongated spring is made of electrically conductive material and is attached for establishing an electrical connection between an area of said sleeve and said drum by way of said bar and said latching means when said sleeve is forced partially into said channel by said bar.

5. An electrophotographic copier as set forth in claim 4 wherein said sleeve has a plastic film backing having thereon a conductive layer and having said conductive layer coated substantially with a photosensitive material except in said sleeve area for electrical connection to said spring.

6. An electrophotographic copier as set forth in claim 1 wherein said elongated bar is pivotally mounted on said drum at one end of said channel.

7. An electrophotographic copier as set forth in claim 6 wherein said spring is of electrically conductive material and is attached for establishing an electrical connection between an area of said sleeve and said drum by way of said bar when said sleeve is forced partially into said channel by said bar.

8. An electrophotographic copier as set forth in claim 6 wherein said spring is an elongated structure having a substantially S-shaped cross section.

9. An electrophotographic copier as set forth in claim 8 wherein said elongated spring is made of electrically conductive material and is attached for establishing an electrical connection between an area said sleeve and said drum by way of said bar when said sleeve is forced partially into said channel by said bar.

10. An electrophotographic copier as set forth in claim 9 wherein said sleeve has a plastic film backing having thereon a conductive layer and having said conductive layer coated substantially with a photosensitive material except in said sleeve area for electrical connection to said spring.

11. An electrophotographic copier as set forth in claim 10 wherein said bar has a slot along the underside thereof for receiving one transverse end of said elongated spring.

12. A clamping device for securing a closed loop sleeve on a drum having a channel on the drum periphery thereof comprising:

a member for fitting within said channel;

means for applying tension to said sleeve in response to forcing of said sleeve partially into said channel by said member; and means for latching said member to said drum;

whereby said sleeve is held on the periphery of said drum.

13. A clamping device for securing a closed loop, flexible sleeve on a drum having a channel on the drum periphery thereof, running substantially parallel to the drum central axis, along the length of said drum comprising:

an elongated bar having a cross-sectional configuration for fitting within said channel;

means for latching said bar to said drum when said bar is in position within said channel; and a spring positioned relative to said bar and said sleeve for applying tension to said sleeve in response to forcing of said sleeve partially into said channel by said bar;

whereby said closed loop, flexible sleeve is held radially inward on the periphery of said drum by the tensioning action of said spring.

14. A clamping device as set forth in claim 13 wherein said spring is of electrically conductive material and is attached for establishing an electrical connection between an area of said sleeve and said drum by way of said bar and said latching means when said sleeve is forced partially into said chamber by said bar.

15. A clamping device as set forth in claim 13 wherein said spring is an elongated structure having a substantially S-shaped cross-section.

16. A clamping device as set forth in claim 15 wherein said elongated spring is made of electrically conductive material and is attached for establishing an electrical connection between said sleeve area and said drum by way of said bar and said latching means when said sleeve is forced partially into said channel by said bar.

17. A clamping device as set forth in claim 16 wherein said sleeve has a plastic film backing having thereon a conductive layer and having said conductive layer coated substantially with a photosensitive material except in said sleeve area for electrical connection to said spring.

18. A clamping device as set forth in claim 13 wherein said elongated bar is pivotally mounted to said drum at one end of said channel.

19. A clamping device as set forth in claim 18 wherein said spring is of electrically conductive material and is attached for establishing an electrical connection between an area of said sleeve and said drum by way of said bar when said sleeve is forced partially into said channel by said bar.

20. A clamping device as set forth in claim 18 wherein said spring is an elongated structure having a substantially S-shaped cross section.

21. A clamping device as set forth in claim 20 wherein said elongated spring is made of electrically conductive material and is attached for establishing an electrical connection between said sleeve area and said drum by way of said bar when said sleeve is forced partially into said channel by said bar.

22. A clamping device as set forth in claim 21 wherein said sleeve has a plastic film backing having thereon a conductive layer and having said conductive layer coated substantially with a photosensitive material except in said sleeve area for electrical connection to said spring.

23. A clamping device as set forth in claim 22 wherein said bar has a slot along the underside thereof for receiving one transverse end of said elongated spring.

24. A clamping device as set forth in claim 23 wherein said spring is slotted to provide greater flexibility and variable tension.

* * * * *